US008217888B2

(12) United States Patent
Chien et al.

(10) Patent No.: US 8,217,888 B2
(45) Date of Patent: Jul. 10, 2012

(54) METHOD FOR PROCESSING IMAGES IN LIQUID CRYSTAL DISPLAY

(75) Inventors: Ming-Fon Chien, Hsin-Chu (TW); Ming-Jong Jou, Hsin-Chu (TW); Yao-Jen Hsieh, Hsin-Chu (TW); Yu-Hsi Ho, Hsin-Chu (TW)

(73) Assignee: Au Optronics Corp., Hsin-Chu (TW)

( * ) Notice: Subject to any disclaimer, the term of this patent is extended or adjusted under 35 U.S.C. 154(b) by 866 days.

(21) Appl. No.: 12/081,442

(22) Filed: Apr. 16, 2008

(65) Prior Publication Data

US 2009/0102781 A1 Apr. 23, 2009

(30) Foreign Application Priority Data

Oct. 18, 2007 (TW) ..... 96139058 A

(51) Int. Cl.
*G09G 3/36* (2006.01)

(52) U.S. Cl. ..... 345/102; 345/89

(58) Field of Classification Search ..... 345/60–104, 345/168, 211, 214, 600–604, 671–672, 690–694
See application file for complete search history.

(56) References Cited

U.S. PATENT DOCUMENTS

| | | | | |
|---|---|---|---|---|
| 5,554,912 | A * | 9/1996 | Thayer et al. | 315/157 |
| 5,872,896 | A * | 2/1999 | Li et al. | 358/1.9 |
| 7,176,878 | B2 | 2/2007 | Lew et al. | |
| 7,609,244 | B2 * | 10/2009 | Kim et al. | 345/89 |
| 7,717,601 | B2 * | 5/2010 | Tan et al. | 362/613 |
| 7,768,496 | B2 * | 8/2010 | Daly | 345/102 |
| 7,786,963 | B2 * | 8/2010 | Hong et al. | 345/89 |
| 7,800,577 | B2 * | 9/2010 | Kerofsky et al. | 345/102 |
| 7,876,340 | B2 * | 1/2011 | Russell et al. | 345/694 |
| 2006/0209005 | A1 * | 9/2006 | Pedram et al. | 345/102 |
| 2007/0001997 | A1 | 1/2007 | Kim et al. | |

* cited by examiner

*Primary Examiner* — Quan-Zhen Wang
*Assistant Examiner* — Michael J Eurice
(74) *Attorney, Agent, or Firm* — Rabin & Berdo, P.C.

(57) ABSTRACT

A method for processing images in a liquid crystal display is provided. The method includes the steps of: acquiring a backlight index according to an image; adjusting a backlight according to the backlight index; acquiring a reference gray level according to the adjusted backlight, wherein the reference gray level lies in between a first gray level boundary and a second gray level boundary; transferring a gray level of the image into a corresponding output gray level according to the backlight index when the gray level of the image lying in between the reference gray level and the first gray level boundary; and transferring the gray level of the image into another corresponding output gray level according to a linear relationship when the gray level of the image lying in between the reference gray level and the second gray level boundary.

20 Claims, 4 Drawing Sheets

METHOD FOR PROCESSING IMAGES IN LIQUID CRYSTAL DISPLAY

RELATED APPLICATIONS

This application claims priority to Taiwan Patent Application Serial Number 96139058, filed Oct. 18, 2007, which is herein incorporated by reference.

BACKGROUND

1. Field of Invention

The present invention relates to a method for processing images. More particularly, the present invention relates to a method for processing images in a liquid crystal display.

2. Description of Related Art

Regarding image contrast enhancement for a conventional liquid crystal display, an input image is mostly processed by being analyzed on a histogram to obtain characteristics of the input image and determine variation of the input image. After that, brightness of a backlight is adjusted, such that the difference of two adjacent gray levels is enlarged and the image contrast is thus enhanced.

Although the foregoing method can be used to achieve the image contrast enhancement, the input image has to be modified before the brightness of the backlight is adjusted. In other words, processing the input image is not related to the adjustment of the brightness of the backlight. As a result, the brightness of the backlight cannot be relatively adjusted according to the image modification, so some areas of one image frame may lack uniformity and appear to be particularly bright or dark when users watch the image frame.

SUMMARY

In accordance with one embodiment of the present invention, a method for processing images in a liquid crystal display is provided. The method includes the steps of: acquiring a backlight index according to an image; adjusting a backlight according to the backlight index; acquiring a reference gray level according to the adjusted backlight, wherein the reference gray level lies in between a first gray level boundary and a second gray level boundary; transferring a gray level of the image into a corresponding output gray level according to the backlight index when the gray level of the image lying in between the reference gray level and the first gray level boundary; and transferring the gray level of the image into another corresponding output gray level according to a linear relationship when the gray level of the image lying in between the reference gray level and the second gray level boundary.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiments, with reference made to the accompanying drawings as follows.

DESCRIPTION OF THE PREFERRED EMBODIMENTS

In the following detailed description, the embodiments of the present invention have been shown and described. As will be realized, the invention is capable of modification in various obvious respects, all without departing from the invention. Accordingly, the drawings and description are to be regarded as illustrative in nature, and not restrictive.

Figure 1:
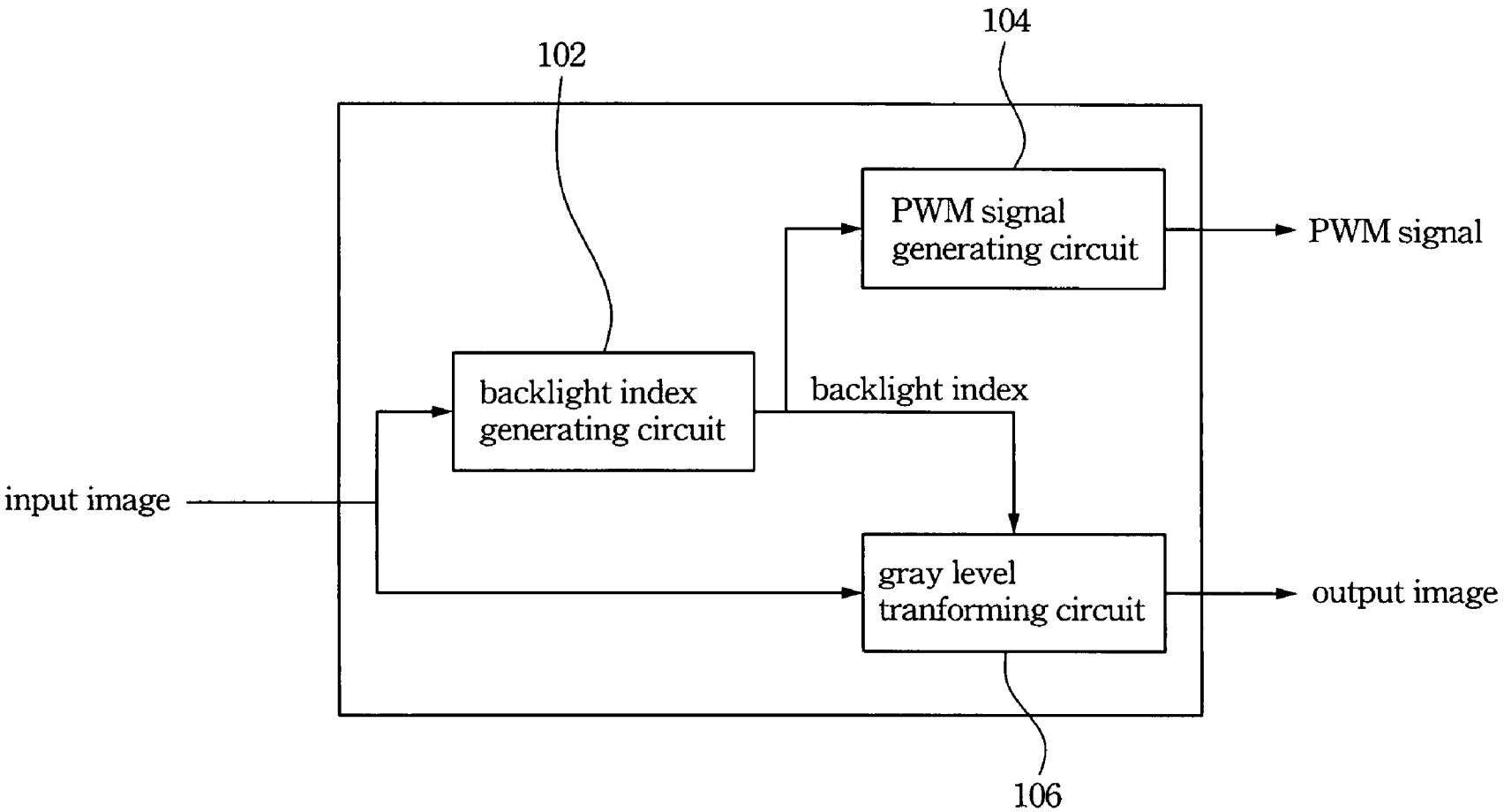
FIG. 1 illustrates a block diagram of an image processing system in a liquid crystal display according to one embodiment of the present invention.

FIG. 1 illustrates a block diagram of an image processing system in a liquid crystal display according to one embodiment of the present invention. The image processing system includes a backlight index generating circuit 102, a pulse width modulation (PWM) signal generating circuit 104, and a gray level transforming circuit 106. The backlight index generating circuit 102 is capable of receiving an input image and generating a backlight index according to the received input image, and then transmits the backlight index to the PWM signal generating circuit 104 and the gray level transforming circuit 106, respectively. The PWM signal generating circuit 104 generates a corresponding PWM signal according to the backlight index, so as to control and adjust brightness of a backlight. The gray level transforming circuit 106 transforms the input image into an output image on the basis of the backlight index and the adjusted brightness of the backlight, and then transmits the output image to a display panel to be displayed.

Figure 2:
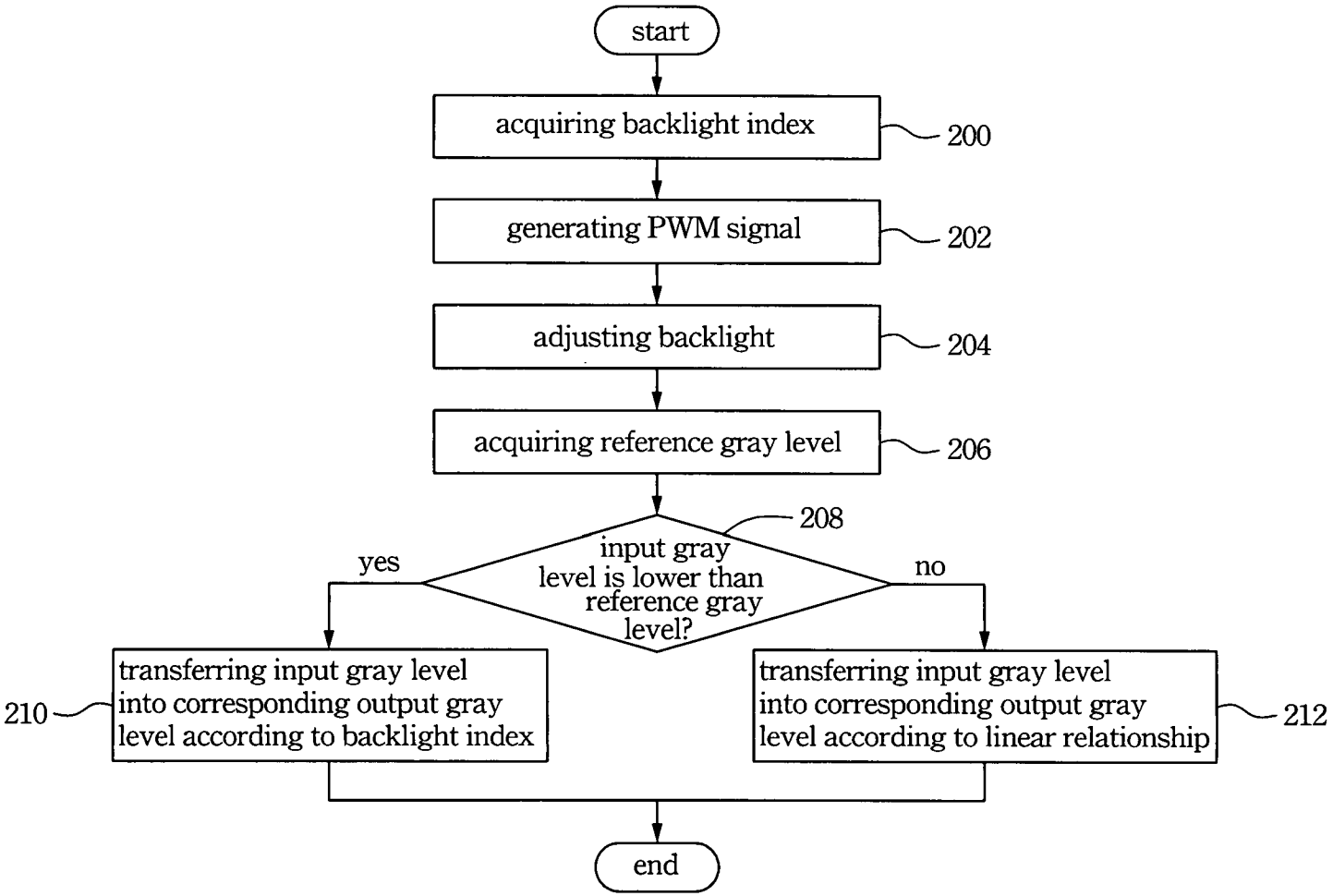
FIG. 2 illustrates a flow chart of a method for processing images according to one embodiment of the present invention.

FIG. 2 illustrates a flow chart of a method for processing images according to one embodiment of the present invention. First, a backlight index is acquired according to an input image (Step 200). The backlight index is varied along with different input images, so the data of the input image can be processed and sorted in a histogram with N gray levels, and then the backlight index can be determined in accordance with the histogram.

Figure 3:
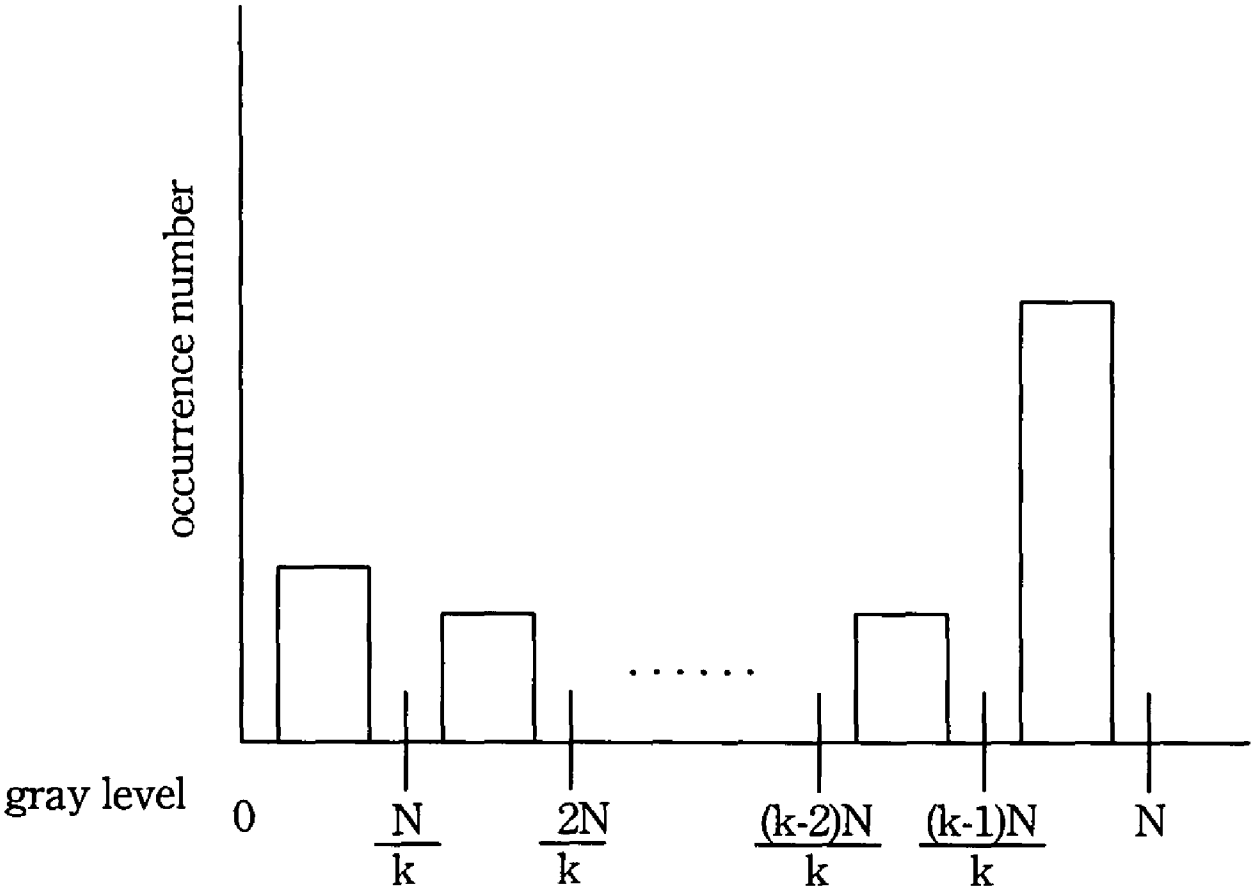
FIG. 3 illustrates a histogram of an input image.

FIG. 3 illustrates a histogram of an input image. The histogram represents the numbers of the gray levels, which are set between the lowest gray level 0 and the highest gray level N, occurring in one image and obtained statistically in accordance with the statistic figure K. Furthermore, the histogram also provides the characteristics of the image, such as levels of the brightness.

After obtaining the numbers of the gray levels occurring in the image, the backlight index can be determined by the following equation (1).

$$BI = BIB + \frac{H}{TP} \times \frac{(M - GLB)}{2} \tag{1}$$

As shown in the equation (1), BI is the backlight index; BIB is a backlight index boundary corresponded by the highest gray level of sub-pixels of the input image; H is the number of the highest gray level of the sub-pixels from histogram of the input image; TP is the total numbers of all gray levels of the input image; M is the highest gray level of the sub-pixels of the input image; GLB is a gray level boundary corresponded by the highest gray level of the sub-pixels of the input image.

The area represented by the high gray level (or low gray level) may just appear in a very little part of one image, so the foregoing equation (1) includes the backlight index boundary BIB and the gray level boundary GLB to determine the backlight index BI more precisely to control the backlight brightness necessary for the high gray level (or low gray level), such that the output image can have better image contrast or relative brightness.

TABLE 1

| gray level range | gray level boundary (GLB) | backlight index boundary (BIB) |
|---|---|---|
| 0~N/k | GLB 1 | BIB 1 |
| N/k~2 * (N/k) | GLB 2 | BIB 2 |
| . . . | . . . | . . . |
| (k − 2)(N/k)~(k − 1)(N/k) | GLB (k − 1) | BIB (k − 1) |
| (k − 1)(N/k)~N | GLB k | BIB k |

The table 1 represents the gray level range corresponding to the gray level boundary and the backlight index boundary. When the highest gray level of the sub-pixels of the input image, i.e. Max(R, G, B), lies in the range 0~N/k, GLB 1 is set to be the gray level boundary of the input image; when Max (R, G, B) lies in the range N/k~2*(N/k), GLB 2 is set to be the gray level boundary of the input image; and so on. On the other hand, when Max(R, G, B) lies in the range 0~N/k, BIB 1 is set to be the backlight index boundary of the input image; when Max(R, G, B) lies in the range N/k~2*(N/k), BIB 2 is set to be the backlight index boundary of the input image, and so on.

After the backlight index is acquired, a backlight is adjusted according to the backlight index, in which a corresponding PWM signal can be generated according to the backlight index at first (Step 202), and then the backlight can be adjusted by the PWM signal (Step 204). Furthermore, in order to accurately control the brightness of the backlight, the brightness of the backlight can be divided into N levels, which include from the dimmest level 0 to the brightest level (N−1), so as to obtain an N-level lookup table (LUT) with the backlight index corresponding to the brightness of the backlight. Then, the relationship between the backlight index and the brightness of the backlight is set based on the real condition and requirement, so as to control the brightness of the backlight.

Moreover, after the backlight is adjusted, a reference gray level is acquired according to the backlight index and the adjusted backlight brightness (Step 206), in which the reference gray level lies in between a first gray level boundary and a second gray level boundary.

Figure 4:
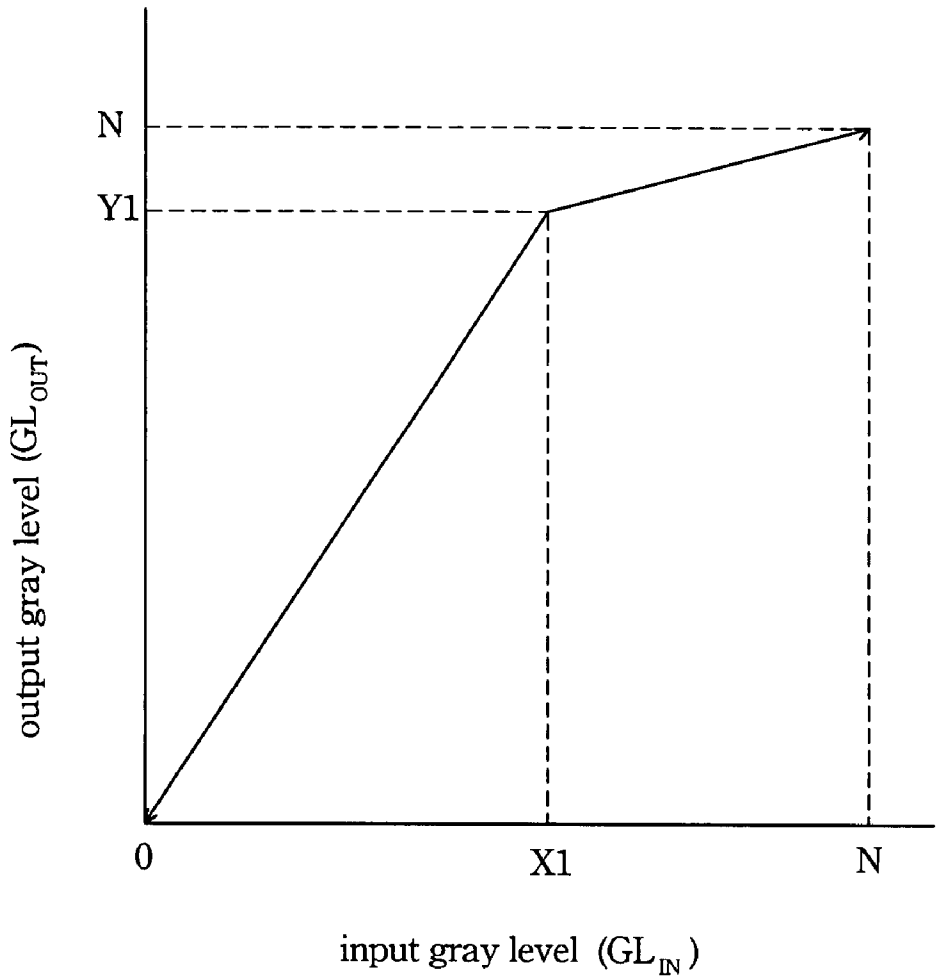
FIG. 4 illustrates a transforming relationship between the input gray level and the output gray level according to one embodiment of the present invention.

FIG. 4 illustrates a transforming relationship between the input gray level and the output gray level according to one embodiment of the present invention. In the present embodiment, the brightness of the backlight is adjusted to be enhanced according to the backlight index, and the first gray level boundary is lower than the second gray level boundary. Besides, the reference gray level lies in between the second gray level boundary and a middle gray level, which lies in between the first gray level boundary and the second gray level boundary; that is, the reference gray level is closer to the second gray level boundary. The first gray level boundary is the lowest gray level of an image frame, and the second gray level boundary is the highest gray level of the image frame. As shown in FIG. 4, X1 is the reference gray level; 0 and N are the first gray level boundary and the second gray level boundary, respectively; $GL_{IN}$ is the input gray level; and $GL_{OUT}$ is the output gray level. X1 can be determined by the following equation (2).

$$X_1 = \frac{(F-1)\times N}{F\times\sqrt[\gamma]{\frac{BL_{Max}}{BL_{Dim}}}-1} \tag{2}$$

As shown in the equation (2), $BL_{Max}$ is the backlight brightness when the backlight is completely turned on; $BL_{Dim}$ is the backlight brightness corresponding to the backlight index; γ is a gamma value; N is the highest input gray level; and F is the ratio of the highest output gray level compared to the highest input gray level.

After the reference gray level is acquired, whether the input gray level $GL_{IN}$ is lower than the reference gray level X1 or not is determined (Step 208). When the input gray level $GL_{IN}$ is lower than the reference gray level X1; that is, when the input gray level $GL_{IN}$ lies in between 0 and the reference gray level X1, the input gray level $GL_{IN}$ is transferred into the corresponding output gray level $GL_{OUT}$ according to the backlight index (Step 210), in which the input gray level $GL_{IN}$ can be transferred into the corresponding output gray level $GL_{OUT}$ in accordance with the gamma value and the adjusted backlight brightness both corresponding to the backlight index. The output gray level $GL_{OUT}$ can be determined by the following equation (3).

$$GL_{OUT} = \sqrt[\gamma]{\frac{BL_{Max}}{BL_{Dim}}}\times GL_{IN} \tag{3}$$

On the other hand, when the input gray level $GL_{IN}$ is higher than the reference gray level X1; that is, when the input gray level $GL_{IN}$ lies in between N and the reference gray level X1, the input gray level $GL_{IN}$ is transferred into the corresponding output gray level $GL_{OUT}$ according to a linear relationship (Step 212). The output gray level $GL_{OUT}$ can be determined by the following equation (4).

$$GL_{OUT} = \frac{GL_{IN}}{F} + \frac{(F-1)\times N}{F} \tag{4}$$

As a result, the high gray level (or low gray level) image can have better image contrast after transformation, such that users are capable of distinguishing the color gradations clearly.

Furthermore, in another embodiment, the brightness of the backlight is adjusted to be declined according to the backlight index, and the first gray level boundary is higher than the second gray level boundary. Besides, the reference gray level lies in between the second gray level boundary and a middle gray level, which lies in between the first gray level boundary and the second gray level boundary; that is, the reference gray level is closer to the second gray level boundary. The first gray level boundary is the highest gray level of an image frame, and the second gray level boundary is the lowest gray level of the image frame. That is, X1 is the reference gray level, and 0 and N are the first gray level boundary and the second gray level boundary, respectively. For this embodiment, when the input gray level $GL_{IN}$ is lower than the reference gray level X1; that is, when the input gray level $GL_{IN}$ lies in between 0 and the reference gray level X1, the input gray level $GL_{IN}$ is transferred into the corresponding output gray level $GL_{OUT}$ according to a linear relationship. On the other hand, when the input gray level $GL_{IN}$ is higher than the reference gray level X1; that is, when the input gray level $GL_{IN}$ lies in between N and the reference gray level X1, the input gray level $GL_{IN}$ is transferred into the corresponding output gray level $GL_{OUT}$ according to the backlight index For the foregoing embodiments of the present invention, the method for processing images in a liquid crystal display can be applied to enhance the image contrast and increase the color gradations, such that the image can be brighter and more colorful. Moreover, the brightness of the backlight can be relatively adjusted and moderately controlled along with the image variation, such that the backlight can be used more efficiently without unnecessary power loss, so as to reduce the power of the backlight accordingly.

As is understood by a person skilled in the art, the foregoing embodiments of the present invention are illustrative of the present invention rather than limiting of the present invention. It is intended to cover various modifications and similar arrangements included within the spirit and scope of the appended claims, the scope of which should be accorded the broadest interpretation so as to encompass all such modifications and similar structures.

What is claimed is:

1. A method for processing images in a liquid crystal display, the method comprising:

(a) acquiring a backlight index in relation to gray levels of an image;

(b) adjusting a backlight according to the backlight index;

(c) acquiring a reference gray level configured to be compared with the gray levels of the image, wherein the reference gray level varies with a backlight brightness of the adjusted backlight corresponding to the backlight index, and the reference gray level lies in between a first gray level boundary and a second gray level boundary;

(d) transferring a gray level of the image into a corresponding output gray level according to a transferring relationship having a first slope when the gray level of the image lies in between the reference gray level and the first gray level boundary; and (e) transferring the gray level of the image into another corresponding output gray level according to a linear relationship having a second slope different from the first slope when the gray level of the image lying in between the reference gray level and the second gray level boundary;

wherein the reference gray level is determined by the following equation:

$$X_1 = \frac{(F-1)\times N}{F\times\sqrt[\gamma]{\frac{BL_{Max}}{BL_{Dim}}}-1}$$

wherein $X_1$ is the reference gray level, $BL_{Max}$ is the backlight brightness when the backlight is completely turned on, $BL_{Dim}$ is the backlight brightness corresponding to the backlight index, γ is a gamma value, N is a highest gray level of the image, and F is a ratio of a highest output gray level compared to the highest gray level of the image.

2. The method as claimed in claim 1, wherein brightness of the backlight is adjusted to be enhanced according to the backlight index, and the first gray level boundary is lower than the second gray level boundary.

3. The method as claimed in claim 2, wherein the reference gray level lies in between the second gray level boundary and a middle gray level that lies in between the first gray level boundary and the second gray level boundary.

4. The method as claimed in claim 2, wherein the first gray level boundary is a lowest gray level of an image frame, and the second gray level boundary is a highest gray level of the image frame.

5. The method as claimed in claim 1, wherein step (d) further comprises:

transferring the gray level of the image into the corresponding output gray level according to the gamma value and the brightness of the adjusted backlight.

6. The method as claimed in claim 1, wherein step (b) further comprises:

generating a corresponding pulse width modulation signal according to the backlight index; and adjusting the backlight by the pulse width modulation signal.

7. The method as claimed in claim 1, wherein step (a) further comprises:

determining the backlight index in relation to at least numbers of the gray levels occurring in the image.

8. The method as claimed in claim 1, wherein in step (d), the transferring relationship between the gray level of the image and the corresponding output gray level is associated with a gamma value and a backlight brightness corresponding to the backlight index.

9. The method as claimed in claim 1, wherein in step (e), the linear relationship between the gray level of the image and the corresponding output gray level is associated with a ratio of a highest output gray level compared to a highest input gray level.

10. The method as claimed in claim 1, wherein when the gray level of the image lies in between the reference gray level and the first gray level boundary, the output gray level is determined by the following equation:

$$GL_{OUT} = \sqrt[\gamma]{\frac{BL_{Max}}{BL_{Dim}}}\times GL_{IN}$$

wherein $GL_{OUT}$ is the output gray level, $GL_{IN}$ is the gray level of the image, $BL_{Max}$ is the backlight brightness when the backlight is completely turned on, $BL_{Dim}$ is the backlight brightness corresponding to the backlight index, γ is a gamma value.

11. The method as claimed in claim 1, wherein when the gray level of the image lies in between the reference gray level and the second gray level boundary, the output gray level is determined by the following equation:

$$GL_{OUT} = \frac{GL_{IN}}{F} + \frac{(F-1)\times N}{F}$$

wherein $GL_{OUT}$ is the output gray level, $GL_{IN}$ is the gray level of the image, N is a highest gray level of the image, and F is a ratio of a highest output gray level compared to the highest gray level of the image.

12. A method for processing images in a liquid crystal display, the method comprising:

transferring a gray level of an image into a corresponding output gray level according to a transferring relationship having a first slope when the gray level of the image lies in between a reference gray level and one of a lowest gray level and a highest gray level of an image frame; and transferring the gray level of the image into another corresponding output gray level according to a linear relationship having a second slope different from the first slope when the gray level of the image lies in between the reference gray level and the other of the lowest gray level and the highest gray level of the image frame;

wherein the variation of the first slope is greater than the variation of the second slope;

wherein the reference gray level is determined by the following equation:

$$X_1 = \frac{(F-1)\times N}{F\times\sqrt[\gamma]{\frac{BL_{Max}}{BL_{Dim}}}-1}$$

wherein $X_1$ is the reference gray level, $BL_{Max}$ is the backlight brightness when the backlight is completely turned on, $BL_{Dim}$ is the backlight brightness corresponding to the backlight index, γ is a gamma value, N is a highest gray level of the image, and F is a ratio of a highest output gray level compared to the highest gray level of the image.

13. The method as claimed in claim 10, wherein when the gray level of the image lies in between the reference gray level and the second gray level boundary, the output gray level is determined by the following equation:

$$GL_{OUT} = \frac{GL_{IN}}{F} + \frac{(F-1)\times N}{F}$$

wherein $GL_{OUT}$ is the output gray level, $GL_{IN}$ is the gray level of the image, N is a highest gray level of the image, and F is a ratio of a highest output gray level compared to the highest gray level of the image.

14. The method as claimed in claim 12, wherein when the gray level of the image lies in between the reference gray level and another of the lowest gray level and the highest gray level of the image frame, the output gray level is determined by the following equation:

$$GL_{OUT} = \frac{GL_{IN}}{F} + \frac{(F-1)\times N}{F}$$

wherein $GL_{OUT}$ is the output gray level, $GL_{IN}$ is the gray level of the image.

15. The method as claimed in claim 12, wherein when the gray level of the image lies in between the reference gray level and one of the lowest gray level and the highest gray level of the image frame, the output gray level is determined by the following equation:

$$GL_{OUT} = \sqrt[\gamma]{\frac{BL_{Max}}{BL_{Dim}}}\times GL_{IN}$$

wherein $GL_{OUT}$ is the output gray level, $GL_{IN}$ is the gray level of the image.

16. The method as claimed in claim 15, wherein when the gray level of the image lies in between the reference gray level and another of the lowest gray level and the highest gray level of the image frame, the output gray level is determined by the following equation:

$$GL_{OUT} = \frac{GL_{IN}}{F} + \frac{(F-1)\times N}{F}$$

wherein $GL_{OUT}$ is the output gray level, $GL_{IN}$ is the gray level of the image.

17. A method for processing images in a liquid crystal display, the method comprising:

(a) acquiring a backlight index in relation to gray levels of an image;

(b) adjusting a backlight according to the backlight index;

(c) acquiring a reference gray level configured to be compared with the gray levels of the image, wherein the reference gray level varies with a backlight brightness of the adjusted backlight corresponding to the backlight index, and the reference gray level lies in between a first gray level boundary and a second gray level boundary;

(d) transferring a gray level of the image into a corresponding output gray level according to a transferring relationship having a first slope when the gray level of the image lies in between the reference gray level and the first gray level boundary; and (e) transferring the gray level of the image into another corresponding output gray level according to a linear relationship having a second slope different from the first slope when the gray level of the image lying in between the reference gray level and the second gray level boundary;

wherein when the gray level of the image lies in between the reference gray level and the first gray level boundary, the output gray level is determined by the following equation:

$$GL_{OUT} = \sqrt[\gamma]{\frac{BL_{Max}}{BL_{Dim}}}\times GL_{IN}$$

wherein $GL_{OUT}$ is the output gray level, $GL_{IN}$ is the gray level of the image, $BL_{Max}$ is the backlight brightness when the backlight is completely turned on, $BL_{Dim}$ is the backlight brightness corresponding to the backlight index, γ is a gamma value;

wherein when the gray level of the image lies in between the reference gray level and the second gray level boundary, the output gray level is determined by the following equation:

$$GL_{OUT} = \frac{GL_{IN}}{F} + \frac{(F-1)\times N}{F}$$

wherein $GL_{OUT}$ is the output gray level, $GL_{IN}$ is the gray level of the image, N is a highest gray level of the image, and F is a ratio of a highest output gray level compared to the highest gray level of the image.

18. The method as claimed in claim 17, wherein step (c) further comprises:

acquiring the gamma value according to the backlight index; and acquiring the reference gray level according to the gamma value and brightness of the adjusted backlight.

19. The method as claimed in claim 17, wherein step (b) further comprises:

generating a corresponding pulse width modulation signal according to the backlight index; and adjusting the backlight by the pulse width modulation signal.

20. The method as claimed in claim 17, wherein step (a) further comprises:

determining the backlight index in relation to at least numbers of the gray levels occurring in the image.

* * * * *